US005316414A

United States Patent [19]

Wright

[11] Patent Number: 5,316,414

[45] Date of Patent: May 31, 1994

[54] MINE ROOF EXPANSION ANCHOR, TAPERED PLUG ELEMENT USED THEREIN AND METHOD OF INSTALLATION

[75] Inventor: Raymond L. Wright, Syracuse, N.Y.

[73] Assignee: The Eastern Company, Naugatuck, Conn.

[21] Appl. No.: 46,579

[22] Filed: Apr. 14, 1993

[51] Int. Cl.[5] ..... E21D 20/02

[52] U.S. Cl. ..... 405/259.6; 405/259.5; 411/73

[58] Field of Search ..... 405/259.5, 259.6; 411/73, 71, 82, 258

[56] References Cited

U.S. PATENT DOCUMENTS 5,033,910 7/1991 Wright ..... 405/259.6
5,078,547 1/1992 Calandra et al. ..... 405/259.61
5,082,399 1/1992 Frease et al. ..... 405/259.6
5,094,577 3/1992 Clark et al. ..... 405/259.1 X

*Primary Examiner*—Dennis L. Taylor
*Attorney, Agent, or Firm*—Charles S. McGuire

[57] ABSTRACT

A mechanical expansion anchor and tapered plug for use therein having particular application in combination with resin grouting materials. The anchor includes conventional shell structure having a plurality of radially expansible leaves with internal surfaces opposing compression surface portions of a tapered camming plug. Components of a resin mix inserted in a drill hole between the blind end thereof and the end of a bolt carrying the expansion anchor flow around the tapered plug and through axial passageways therein. The plug is distinguished by the provision of axial grooves for passage of resin components in the compression surfaces of the plug.

22 Claims, 2 Drawing Sheets

MINE ROOF EXPANSION ANCHOR, TAPERED PLUG ELEMENT USED THEREIN AND METHOD OF INSTALLATION

BACKGROUND OF THE INVENTION

The present invention relates to mine roof expansion anchors of the type having a radially expansible shell and a tapered plug moveable axially within the shell to effect expansion thereof. More specifically, the invention relates to novel structures of mine roof expansion anchors and tapered plug elements thereof for installation together with a resin grouting mix in a drill hole in a mine roof, or the like, and to methods of installation of combined resin-mechanical anchors.

For many years, one of the most popular means of providing support and reinforcement to mine roofs and other subterranian structures has been the mechanical expansion anchor. Such anchors have been proposed in a wide variety of designs having in common a radially expansible shell portion and a tapered plug having an internally threaded, axial bore. The threaded end of a bolt or other elongated rod is engaged with the bore of the tapered plug and the shell is suitably supported in surrounding relation to the smaller end of the plug. The end of the rod carrying the anchor is inserted into a pre-drilled hole in the rock structure, and the shell is expanded into tight engagement with the drill hole wall by rotation of the bolt to move the larger portion of the plug into the shell.

More recently, the effectiveness and useful life of anchorages have been enhanced by the use of quick-setting resin grouting mixes conjointly with mechanical anchors. Such mixes are commercially available in elongated, breakable tubes or cartridges having a diameter approximating that of the drill hole, and separate compartments containing a resin and a catalyst which are in a flowable condition prior to mixing. The lengths of the resin cartridge and bolt are so related to the depth of the drill hole that forced insertion of the bolt crushes the cartridge against the end of the drill hole, releasing the two components which are mixed to the extent necessary as they pass through and around the anchor and end of the bolt, and by rotation of the bolt to move the plug axially into the shell. Upon mixing of the components, the grouting mix hardens in a few seconds.

Since the large end of the tapered plug is positioned nearest the resin cartridge and is often substantially as large in diameter as the drill hole, provision must be made for allowing the grouting mix components to flow past the plug and through the shell to surround the end of the bolt. Among a significant number of U.S. patents noting the need for resin flow passages in such installations are U.S. Pat. Nos. 4,859,118, 4,969,778 and 5,009,549. In the anchors of these and other patents, the passages are provided by axial grooves between external compression surfaces on the tapered plug. That is, the plurality of radially expansible leaves, typically two, three or four in number, which form the shell structure are circumferentially spaced from one another and have internal surfaces which are contacted by opposing surfaces of the tapered plug. As the larger end of the plug is moved axially between the leaves to force outward expansion thereof, the leaves are compressed between the plug and the drill hole wall and an inwardly compressive force is exerted on the surface portions of the plug which contact the shell leaves. Prior art expansion anchors for use with resin cartridges have traditionally provided resin flow passages in the portions of the plug between the compression surfaces, i.e., between the surfaces which directly oppose the internal surfaces of the shell leaves.

It is a principal object of the present invention to provide a mechanical expansion anchor for use in conjunction with a resin cartridge to anchor a mine roof bolt in a drill hole wherein the anchor has an improved design to enhance the flow of resin mix components through and around the anchor.

Another object is to provide an improved tapered camming plug for a mine roof anchor which enhances performance of the anchor when used with a resin grouting mix.

A further object is to provide a tapered plug with uniquely positioned resin flow passages for use in combined resin-mechanical anchorages for rock structure supports.

Still another object is to provide a novel method of anchoring the distal end of a mine roof bolt in a drill hole using both a mechanical anchor and resin to achieve enhanced performance.

Other objects will in part be obvious and will in part appear hereinafter.

SUMMARY OF THE INVENTION

In accordance with the foregoing objects, the invention is embodied in a mechanical expansion anchor having the usual plurality of circumferentially spaced leaves or fingers which are radially expansible by axial movement therebetween of a tapered nut or camming plug in response to rotation of an elongated bolt threadedly engaged with the tapered plug. The end of the bolt carrying the anchor is inserted into a preformed drill hole in the rock formation to be supported with a resin grouting mix, preferably in a two-compartment cartridge, inserted between the anchor and the blind end of the drill hole. The tapered plug has the usual resin flow passages in the form of axial grooves in its external surfaces between the surface portions which directly oppose the internal surfaces of the shell leaves. The tapered plug of the present invention is distinguished from the prior art by the provision of additional resin flow passages in the form of grooves extending into the compression surfaces of the tapered plug from the larger end thereof axially of the plug. Preferably, one such groove is provided in each compression surface and the depth of the grooves is greatest at their juncture with the large end of the plug.

The method of the invention involves causing a portion of the resin components to flow through passages in the areas between the opposing surfaces of the shell leaves and the plug.

DETAILED DESCRIPTION

Figure 1:
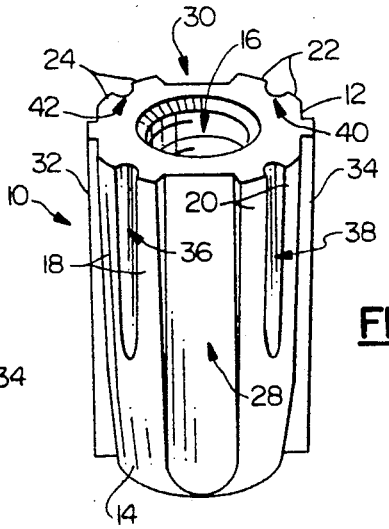
FIG. 1 is a perspective view of a tapered plug element of a mine roof expansion anchor embodying the present invention.
Figure 2:
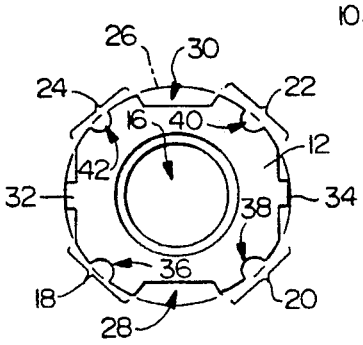
FIGS. 2 and 3 are top and bottom plan views, respectively, of the plug of FIG. 1.
Figure 4:
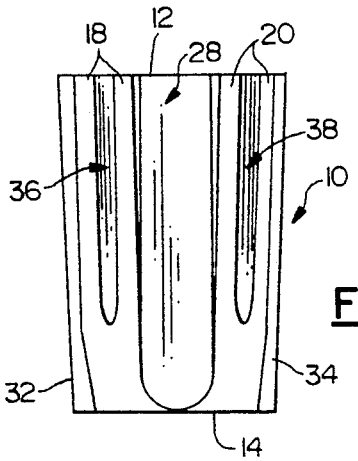
FIG. 4 is a front elevational view of the plug.
Figure 3:
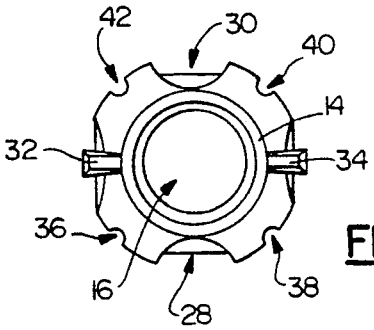

Referring now to the drawings, in FIGS. 1–4 is shown a preferred embodiment of the tapered plug of the present invention. The plug comprises a body member, generally denoted by reference numeral 10 and typically formed as a malleable iron casting. Body 10 is of generally cylindrical configuration, tapering on its exterior from end 12, of relatively larger cross-dimension, to smaller end 14. The taper may be constant throughout the axial length of body 10 or may, as shown, include two or more axial portions with different degrees of taper, the most gradual or shallowest taper extending from large end 12. In the illustrated embodiment, the surfaces of ends 12 and 14 are planar, parallel to one another and perpendicular to the axis of central, through bore 16 which is drilled and tapped to provide internal threads for mating engagement with the threaded end of an elongated bolt or rod, as explained later.

The external surface of body 10 includes four portions 18, 20, 22 and 24 tangent to a circle 26 (FIG. 2) at large end 12. Surface portions 18 and 20 are separated by flat-bottomed groove 28; likewise, flat-bottomed groove 30 separates surface portions 22 and 24. Ribs 32 and 34 extend outwardly from indented portions between surface portions 18 and 24, and portions 20 and 22, respectively, extending axially the full length of body 10.

Rounded grooves 36, 38, 40 and 42 extend into surface portions 18, 20, 22 and 24, respectively. Each of grooves 36, 38, 40 and 42 extends from an open end at junctures of the grooves with the surface of body end 12, axially of body 10 for a portion of its length. In the illustrated , preferred embodiment, one groove is provided in each of the surface portions, centrally thereof. Although the number of grooves is preferably equal to the number of surface portions, this number may vary depending on the design of the anchor in which the plug is incorporated, as explained later. All of grooves 36, 38, 40 and 42 are equal to one another in width, length and depth, proportionate to the dimensions of surface portions 18, 20, 22 and 24, as well as the overall dimensions of body 10, specific examples of such dimensions appearing later herein.

Figure 5:
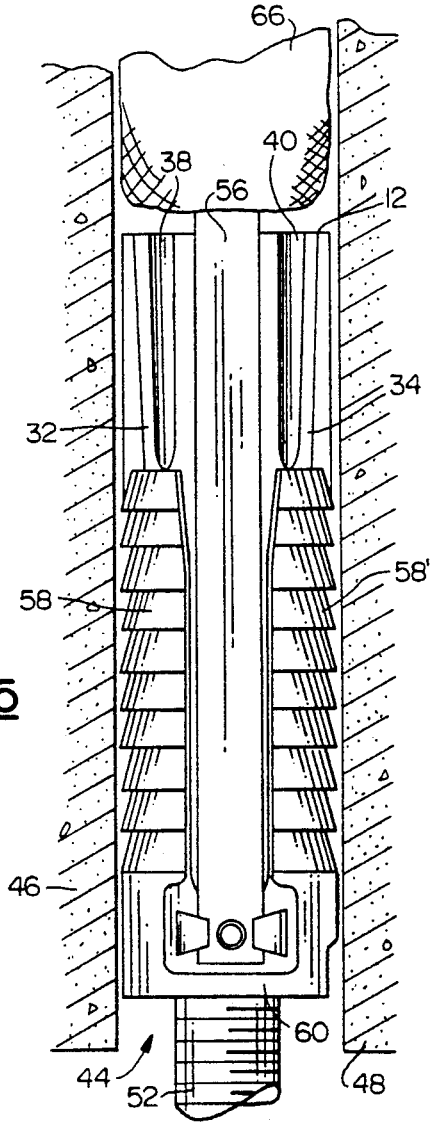
FIG. 5 is a front elevational view of an assembled mine roof expansion anchor including the plug of FIGS. 1–4, inserted into a drill hole in a mine roof together with a resin cartridge.
Figure 7:
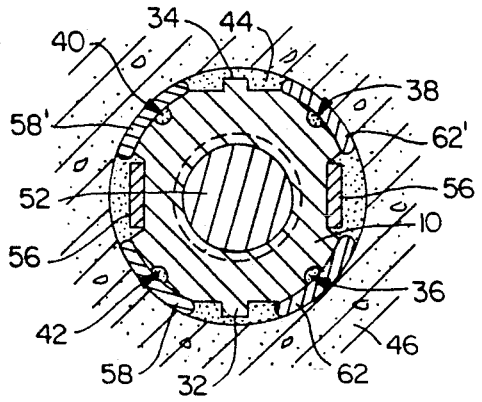
FIG. 7 is a top plan view in section on the line 7—7 of FIG. 6.
Figure 6:
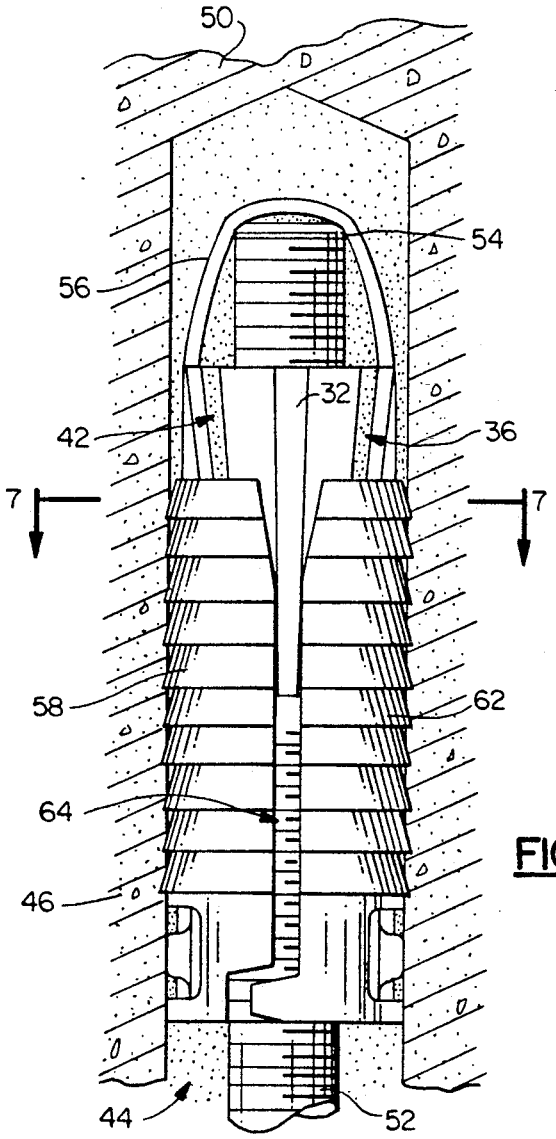
FIG. 6 is a front elevational view, showing the anchor assembly, of FIG. 5 fully installed in a drill hole with the resin components.

Turning now to FIGS. 5–7, the tapered plug of FIGS. 1–4 is shown as part of a typical anchorage system for a mine roof bolt. Drill hole 44 is formed in rock structure 46, extending from surface 48 (FIG. 5) to a blind end 50 (FIG. 6). Drill hole 44 has a depth an inch or so greater than the length of the portion of bolt 52 positioned in the hole. Bolt 52 has threads extending from distal end 54 for a portion of its length to mate with the internal threads of bore 16 in plug body 10. The proximal end of bolt 52 (not shown) has an integral head or other means for engagement by a power wrench to effect insertion and rotation of the bolt in a well-known manner, thereby urging a bearing plate carried by the proximal end of the bolt into tight engagement with surface 48 and tensioning the bolt.

In the illustrated form, the mechanical expansion anchor includes, in addition to plug body 10, bail element 56 and a radially expansible shell structure comprising two identical halves, each having a pair of leaves. One of the shell halves is seen in FIG. 5, leaves 58, 58' being laterally spaced from one another and integrally joined at their lower ends by bridge portion 60 to which one end of bail element 56 is permanently attached. Portions of both shell halves are shown in FIG. 6, one leaf 62 of the shell half not seen in FIG. 5 being spaced from leaf 58 by gap 64. The leaves of the respective shell halves are also separated by gaps through which opposite legs of bail element 56 extend. The shell halves are maintained in assembled relation with one another and with the tapered plug by bail element 56, with the small end of the plug extending into the upper end of the shell structure.

A commercially available form of breakable cartridge 66, holding two components of a resin grouting mix in separate compartments, is inserted into drill hole 44 ahead of distal end 54 of bolt 52, carrying the mechanical expansion anchor. As bolt 52 is forcibly pushed into drill hole 44 to bring distal end 54 of the bolt near blind end 50 of the drill hole, cartridge 66 is ruptured, releasing the components which are initially in a flowable state. The grouting mix components may flow to some extent around end 12 of plug body 10, but it is preferred that the largest cross-dimension of the plug be only slightly smaller than the diameter of drill hole 54. Thus, the bulk of the grouting mix components must flow through the passageways formed by grooves 28 and 30, the spaces on each side of ribs 32 and 34, and grooves 36, 38, 40 and 42.

After bolt 52 is fully inserted, it is rotated by the aforementioned power wrench in a direction causing plug body 10 to travel axially down the bolt threads, forcing the progressively larger portion of the plug into the space surrounded by the shell leaves. In so doing, surface portions 18, 20, 22 and 24 slidingly engage the opposing, internal surfaces of the leaves, forcing the serrated, external surfaces of the leaves into gripping engagement with the wall of drill hole 44. Rotation of the shell is inhibited by frictional engagement of its outer surface with the drill hole wall, and rotation of the plug is inhibited by engagement of ribs 32 and 34 in the gaps between the shell halves. Continued application of torque to bolt 52 up to a predetermined maximum tensions the bolt to a desired degree to compress and reinforce the rock strata. The two components of the resin grouting are mixed to the degree necessary to initiate hardening by the hydraulic pressures developed as cartridge 66 breaks, by their flow through the axial passageways and grooves of plug body 10, and by rotation of bolt 52. In a typical installation, only about 3 seconds of bolt rotation is required and hardening of the resin grout is essentially complete in about 10 seconds.

Although the mechanical expansion anchor illustrated herein is of the type shown in U.S. Pat. No. 5,094,577, it will be understood that the invention may be practised with a wide variety of anchor designs. These include not only bail-type anchors, but also those having a unitary shell structure initially held in position by a support nut on the bolt. Also, the number of shell leaves may be other than four, with a corresponding number of opposing plug surface portions each preferably having one, centrally disposed, axial, resin passage groove.

As previously mentioned, dimensions of the various portions of plug body 10 will vary with the type and dimensions of the shell with which it is used, as well as with other design and application considerations. The provision of resin passageways in the compression surfaces of the plug not only enhances performance of the combined resin-mechanical anchor by easier and more complete mixing and distribution of the grouting material around the anchor, but also permits the maximum cross-dimension at the larger end of the plug to be closer to the drill hole diameter. This, in turn, permits greater shell expansion in installations where required.

By way of example, in an expansion anchor for use in a 1⅜" diameter drill hole with a ⅝" or ¾" diameter bolt, grooves 36, 38, 40 and 42 may be 0.156"wide and 0.070"deep at their junctures with end 12 of body 10. The diameter of circle 26, representing the largest cross-dimension of plug body 10, may be on the order of 1.3". Since external surface portions 18, 20, 22 and 24 taper to a smaller diameter from end 12 toward end 14, the lower ends of grooves 36, 38, 40 and 42 merge with the surface portions approximately 1½"below end 12 in a plug body having an overall length between ends 12 and 14 of 2". In typical plug designs, the angle of taper is constant over each of a plurality of axial sections of the plug, increasing in each section from end 12 to end 14. Thus, the external surfaces of the plug do not contact the internal leaf surfaces in those sections adjacent end 14, permitting the resin components to exit the lower ends of grooves 36, 38, 40 and 42.

It should be noted that, although the resin flow passages are shown and described in the preferred embodiment as entirely within the plug compression surfaces, part or all of the flow passages may be provided by grooves in the leaf internal surfaces. That is, the gist of the invention resides in the provision of resin flow passages through one or more of the pairs of opposed, mutually engaged surfaces of the leaves and plug, and to the method of installation wherein resin components are caused to flow through passages extending continuously through the area between the opposed leaf and plug surfaces. Accordingly, the scope of the invention is defined and limited only by the following claims.

What is claimed is:

1. A tapered plug element for use in a mine roof expansion anchor in conjunction with a resin grouting material initially in flowable form, said plug element consisting of body member comprising;

a) first and second ends and an axial bore extending through said body member between said first and second end about a central axis, said bore being internally threaded over at least a portion of its length;

b) a plurality of external, compression surface portions extending axially between said first and second ends and lying tangent to circles concentric with said central axis in each plane normal to said axis, the circle at the plane of said first end defining the largest cross-dimension of said body member, said circles decreasing in diameter from said first to said second ends, each of said surface portions being circumferentially spaced from the circumferentially adjacent surface portions by one of a plurality of first, axially extending grooves; and c) at least one second groove in at least one of said compression surface portions, said second groove extending axially from said first end for at least a portion of the distance to said second end.

2. The plug element of claim 1 wherein one of said second grooves is formed in each of said compression surface portions.

3. The plug element of claim 2 wherein each of said second grooves is substantially centrally located in a respective one of said compression surface portions.

4. The plug element of claim 3 wherein the number of said compression surface portions and said second grooves is four.

5. The plug element of claim 4 wherein a pair of said first plurality of grooves comprise axially extending slots on diametrically opposite sides of said body member, said slots being positioned between first and second pairs of said surface portions.

6. The plug element of claim 5 and further including a pair of axially extending ribs on diametrically opposite sides of said body member, one of said ribs being positioned between said compression surface portions of said first pair and the other of said ribs being positioned between said compression surface portions of said second pair.

7. The plug element of claim 1 wherein the width of said groove at said plane of said first end is between about 30% and 40% of the width of said one surface portion.

8. The plug element of claim 7 wherein the depth of said second groove at said plane of said first end is between about ⅓ and ½ of said second groove width at said plane of said first end.

9. The plug element of claim 8 wherein one of second grooves is substantially centrally located in each of said compression surface portions.

10. The plug element of claim 9 wherein said second grooves have widths and depths substantially equal to one another in each plane transverse to said axis.

11. The plug element of claim 10 wherein said compression surface portions have a circumferential extent substantially equal to one another in each plane normal to said axis.

12. A mechanical expansion anchor for securing a threaded end of a mine roof bolt in a blind drill hole of a rock formation, said anchor comprising;

a) a hollow shell portion having a plurality of leaves, each having an inner and an outer surface, arranged about a first, central axis, said leaves being substantially radially expansible with respect to said first axis to bring said outer surfaces into tightly gripping engagement with the wall of said drill hole;

b) a tapered plug element having first and second ends, a central, through bore with a second, central axis for threaded engagement with said end of said bolt and a plurality of circumferentially spaced, external surface portions extending axially between said first and second ends, the cross dimension in any radial direction through said second axis and intersecting at least one of said surface portions being larger at said first end than the cross dimension in the same radial direction at said second end, each of said plug surface portions and a respective one of said leaf inner surfaces being in direct, mutual contact to define a plurality of pairs of opposed engagement surfaces; and c) at least one flow passage positioned between at least one of said pairs of engagement surfaces and extending from said first end to said second end of said plug for passage of a flowable material between said opposed engagement surfaces.

13. The expansion anchor of claim 12 wherein said flow passage comprises a groove in at least one of said plug surface portions said groove extending axially of said plug from said first end for at least a portion of the distance to said second end.

14. The expansion anchor of claim 13 wherein one of said grooves is formed in each of said surface portions.

15. The expansion anchor of claim 14 wherein the number of said leaves and said surface portions is four.

16. The expansion anchor of claim 14 wherein each of said grooves is substantially centrally located in a respective one of said surface portions, and extends substantially parallel to said second axis.

17. The expansion anchor of claim 16 and further including a pair of axially extending slots on diametrically opposite sides of said plug between adjacent ones of said surface portions, and a bail member having a medial portion extending over said first end of said plug and a pair of legs extending integrally from said medial portion through said slots.

18. Anchoring means for securely holding the distal end of a mine roof bolt in a blind drill hole of predetermined diameter, said anchoring means comprising;

a) a rupturable resin cartridge having separate compartments containing respective components of a hardenable resin grouting mix initially in a flowable state;

b) a shell portion having a plurality of elongated leaves each having an inner and an outer surface and upper and lower ends;

c) means supporting said leaves substantially symmetrically about a central axis with adjacent leaves circumferentially spaced from one another;

d) a tapered plug element having upper and lower ends of respectively larger and smaller cross dimensions, said plug lower end extending into the space surrounded by said leaf upper ends and said plug upper end being sufficiently large for expanding said leaves radially outwardly upon movement of said upper end into said space;

e) said plug having a plurality of external surface portions equal in number to said leaves, said plug surface portions being in substantially continuous lateral engagement with respective ones of said leaf inner surfaces to define a plurality of pairs of opposed engagement surfaces; and f) at least one flow passage extending substantially parallel to said central axis through at least one of said pairs of engagement surfaces for passage of said components from said upper to said lower end of said plug.

19. The anchoring means of claim 18 wherein said flow passage comprises a groove in at least one of said plug surface portions.

20. The anchoring means of claim 18 wherein said flow passage comprises a groove in each of said plug surface portions extending from said plug upper end for at least a portion of the distance to said plug lower end.

21. The method of anchoring the distal, threaded end of a mine roof bolt in a blind drill hole of predetermined diameter, said method comprising;

a) supporting a radially expansible shell with a plurality of elongated leaves, each having an inner and an outer surface, in substantially symmetrical, surrounding relation to said bolt end with said inner surfaces in spaced relation thereto and the outermost portions of said outer surfaces lying on a circle of not greater than said predetermined diameter;

b) threadedly engaging a tapered plug with said bolt end, said plug having a small end extending into the space between said bolt and said leaf inner surfaces, a large end having a cross-dimension sufficient when moved into said space to move said leaf outer surfaces outwardly into tightly gripping engagement with the wall of said drill hole, and a plurality of external engagement surfaces extending axially at least a portion of the distance between said large and small ends, each of said engagement surfaces being in direct engagement with a respective one of said leaf inner surfaces;

c) providing at least one, continuous flow passage extending through the area between at least one of said leaf inner surfaces and the respective one of said plug engagement surfaces in engagement therewith for passage of a flowable material from said large to said small end of said plug;

d) inserting into said drill hole a rupturable cartridge having separate compartments containing respective components of a hardenable resin grouting mix initially in a flowable state;

e) advancing said distal end of said bolt, with said plug and said shell thereon, into said drill hole behind said cartridge to rupture said cartridge against the blind end of said drill hole and release said components and causing flow of at least a portion thereof through said flow passage; and f) rotating said bolt to move said plug axially thereon and move said leaf outer surfaces outwardly into tightly gripping engagement with said bore hole wall.

22. The method of claim 21 and further comprising providing a flow passage extending through the area between each of said leaf inner surfaces and the corresponding plug engagement surfaces, and causing flow of at least a portion of said components through each of said flow passages.

* * * * *